United States Patent [19]

Lauke et al.

[11] Patent Number: 4,939,068

[45] Date of Patent: Jul. 3, 1990

[54] ANODIC OXIDATION OF THE SURFACE OF ALUMINUM OR ALUMINUM ALLOYS

[75] Inventors: Harald Lauke, Mannheim; Bernhard Nick; Reinhold J. Leyrer, both of Ludwigshafen, all of Fed. Rep. of Germany

[73] Assignee: BASF Aktiengesellschaft, Ludwigshafen, Fed. Rep. of Germany

[21] Appl. No.: 278,366

[22] Filed: Dec. 1, 1988

[30] Foreign Application Priority Data

Dec. 1, 1987 [DE] Fed. Rep. of Germany ..... 3740698

[51] Int. Cl.[5] ..... G03C 1/94; G03C 1/74; C25D 5/00; C25D 11/08

[52] U.S. Cl. ..... 430/278; 430/276; 204/58; 204/38.7; 204/38.3

[58] Field of Search ..... 204/58, 38.7, 38.3; 430/278, 276

[56] References Cited

U.S. PATENT DOCUMENTS

| | | | |
|---|---|---|---|
| 3,935,080 | 1/1976 | Gumbinner et al. | 204/28 |
| 3,945,899 | 3/1976 | Nikaido et al. | 204/58 |
| 4,063,949 | 12/1977 | Uhlig et al. | 96/27 E |
| 4,087,341 | 5/1978 | Takahashi et al. | 204/129.43 |
| 4,301,229 | 11/1981 | Sakaki et al. | 430/158 |
| 4,383,897 | 5/1983 | Gillich et al. | 204/33 |
| 4,399,021 | 8/1983 | Gillich et al. | 204/38 A |
| 4,448,647 | 5/1984 | Gillich et al. | 204/33 |
| 4,452,674 | 6/1984 | Gillich et al. | 204/33 |

FOREIGN PATENT DOCUMENTS

| | | | |
|---|---|---|---|
| 0089802 | 9/1983 | European Pat. Off. . | |
| 0256256 | 2/1988 | European Pat. Off. . | |
| 2540561 | 4/1976 | Fed. Rep. of Germany | 430/278 |
| 3627585 | 2/1987 | Fed. Rep. of Germany . | |

OTHER PUBLICATIONS

Japanese Patent Abstract 57-101,695, pending U.S. application No. 064,539 (Lauke et al.).

K. H. Naser, "Physikalisch-Chemische Rechenaufgaben" published 1970, 4th Ed., p. 370.

*Primary Examiner*—Paul R. Michl
*Assistant Examiner*—Cynthia Hamilton
*Attorney, Agent, or Firm*—Keil & Weinkauf

[57] ABSTRACT

The surface of plates, foils or ribbons consisting of aluminum or aluminum alloys are anodically oxidized in an aqueous electrolyte as the anodizing bath by a process in which the electrolyte used may contain organic and inorganic acids together with further additives. The aqueous electrolyte must contain one or more silanes I of the formula I $$X-(CH_2)_y-Si(R^1)_n(OR^2)_{3-n} \qquad \text{I}$$

where y is an integer from 1 to 4, n, independently of y, is 0, 1 or 2, $R^1$ and $R^2$ are each $C_1$–$C_9$-alkyl or $C_6$–$C_{12}$-aryl, X is selected from $X^1$ to $X^{11}$

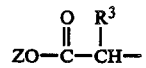
$X^1$

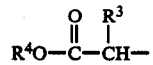
$X^2$

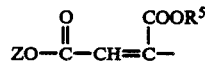
$X^3$

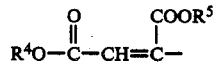
$X^4$

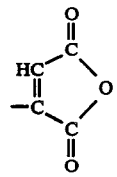
$X^5$

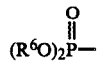
$X^6$

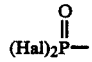
$X^7$ $ZO_3S-$ $X^8$ $HalO_2S-$ $X^9$ $ZO_3S-Ar-$ $X^{10}$ $HalO_2S-Ar-$ $X^{11}$ where $R^3$ is hydrogen, $C_1$–$C_9$-alkyl, an alkanecarboxylic acid group of 1 to 9 carbon atoms or a carboxylic anhydride ring obtained by reacting one of the said alkanecarboxylic acid groups of 1 to 9 carbon atoms with the methylenecarboxylic acid group

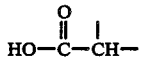

bonded to $R^3$, $R^4$ and $R^5$ are each $C_1$–$C_9$-alkyl or $C_6$–$C_{12}$-aryl, $R^6$ is hydrogen, $C_1$–$C_{12}$-alkyl or $C_6$–$C_{12}$-aryl, Z is hydrogen or an alkali metal cation, Ar is $C_6$–$C_{12}$-arylene and Hal is chlorine or bromine.

The silanes I are added to the aqueous electrolyte as such or as an aqueous or an aqueous alcoholic solution. After the preparation of the anodizing bath, the plates, foils or ribbons consisting of aluminum or aluminum alloys are dipped into the anodizing bath. The surface of the said plates, foils or ribbons is then subjected to continuous or batchwise anodic oxidation, a surface layer consisting essentially of aluminum oxides being obtained. In a preferred embodiment, the said surface layer is coated with a photosensitive recording layer.

10 Claims, No Drawings

ANODIC OXIDATION OF THE SURFACE OF ALUMINUM OR ALUMINUM ALLOYS

The present invention relates to a novel process for the anodic oxidation of the surface of plates, foils or ribbons consisting of aluminum or aluminum alloys in an aqueous electrolyte containing one or more acids and one or more additives. The present invention furthermore relates to the use of the products obtained by the novel process for the production of photosensitive lithographic printing plates or offset printing plates.

Because of their advantageous property profile, parts consisting of aluminum or aluminum alloys are used in various forms in a very wide range of industrial areas. For example, they are used for architectural purposes, for construction of light-weight engines or, in the form of plates, foils or ribbons, as bases for printing plates, in particular lithographic printing plates, which are generally also referred to as offset printing plates.

In order that, despite the very negative normal potential $e_o$ of the $Al^{3\oplus}$ cation of $-1.66$ V (cf. K. H. Naser, page 370), parts consisting of aluminum or aluminum alloys can be used at all for all these purposes, and can display their advantages there, permanent passivation of their surface with a surface layer essentially consisting of aluminum oxides is necessary.

This surface layer is mainly responsible for the performance characteristics and hence the suitability of the moldings of aluminum or aluminum alloys. The most important properties which this surface layer must have include, for example, good corrosion resistance, a good appearance, a precisely adjustable density, great hardness, good resistance to wear, high absorptivity and adhesion for coatings, resins and photosensitive mixtures, good colorability, high gloss and good hydrophilic properties. Plates, toils and ribbons of aluminum or aluminum alloys which are used as bases for photosensitive lithographic printing plates or offset printing plates have to meet particularly high requirements with respect to density, hardness, resistance to wear, absorptivity and adhesion for a very wide variety of photosensitive mixtures, hydrophilic properties and also toughness, breaking strength, layer structure, chemical and physical stability and ink-conveying properties.

It is known that these surface layers essentially consisting of aluminum oxides are produced by anodic oxidation of moldings of aluminum or aluminum alloys in an aqueous electrolyte containing sulfuric acid or phosphoric acid. The quality of the surface layers produced thereby depends in particular on the preselected process parameters, such as duration of the electrolysis, electrolysis voltage, current density, electrolyte temperature and acid concentration. By skillfully choosing the parameters, suitable surface layers can be produced. However, these do not fully meet the high requirements set in practice for the surface layers of the plates, foils or ribbons used for printing purposes.

It has therefore long been the practice to add, in addition to sulfuric acid and/or phosphoric acid, other acids from the group consisting of the inorganic mineral acids, the low molecular weight monofunctional and polyfunctional organic carboxylic, sulfonic and phosphonic acids and the oligomeric and high molecular weight polyfunctional carboxylic, sulfonic and phosphonic acids to the aqueous electrolytes. Moreover, many additives from the group consisting of the inorganic and organic salts and the low molecular weight oligomeric and high molecular weight non-acidic organic compounds have been mixed with the aqueous electrolytes in molecular disperse form or in the form of a colloidal solution. Instead of a fairly long list, reference may be made to EP-No. B-0 048 909 and EP-No. B-0 050 216, where the relevant prior art is treated extensively.

The final aim of all these variations in the electrolyte composition was to obtain additional degrees of freedom in the choice of the process parameters of the anodic oxidation and to change the chemical composition, the structure and the physical properties of the surface layers essentially consisting of aluminum oxides in such a way that they have the property profile required for the intended use.

However, this aim has not yet always been fully achieved in practice in the case of plates, foils or ribbons which are used as bases for photosensitive lithographic printing plates or offset printing plates, which is evident simply from the large number of processes for improving the surface layers produced by known processes of anodic oxidation and essentially consisting of aluminum oxides. In this respect too, reference may be made to EP-No. B-0 048 909 and EP-No. B-0 050 216, where such processes for improvement are discussed.

There is therefore still a considerable need for a process for the anodic oxidation of plates, foils or ribbons of aluminum or aluminum alloys which is simple to carry out, does not necessitate any changes and hence new investment in existing plants and apparatuses and gives bases for photosensitive lithographic printing plates and offset printing plates which also meet the highest requirements in practice.

This aim has partially been achieved with the aid of the process for anodic oxidation described in EP-No. B-048 909, but not completely. In the process described there, oligomeric or high molecular weight, polyfunctional acids are added to the aqueous electrolyte, and polyvinylphosphonic acid has become particularly important among these acids. This known process permits the production of anodically oxidized plates, foils or ribbons of aluminum or aluminum alloys which, when used as bases of photosensitive lithographic printing plates or offset printing plates, have certain advantages with respect to the adhesion of the photosensitive recording layers to the base, the corrosion resistance and the shelf life. The lithographic printing plates or offset printing plates produced from these photosensitive lithographic printing plates or offset printing plates, exposed imagewise to actinic light and washed out with a developer also have certain advantages in terms of the hydrophilicity of their base surface and the long print run with good printed copies.

The known process nevertheless still has disadvantages. For example, the polyvinylphosphonic acid particularly preferably used in this process frequently leads, in the course of the electrolysis, to deposition of sparingly soluble polyvinylphosphonic acid/aluminum complexes on the surfaces to be anodically oxidized, which interferes with the layer build-up. This results in sensitive wetting problems in the lithographic printing plates or offset printing plates exposed imagewise to actinic light and washed out with a developer, leading to poor ink transport or even to fragmentation in the printing areas of the printing plates during printing, with the result that both the quality of the printed copies and the length of the print run are reduced. Moreover, the plates, foils or ribbons consisting of aluminum or aluminum alloys and anodically oxidized by the known process show signs of aging during storage in their surface layers essentially consisting of aluminum oxides, the said aging leading to reduced hydrophilicity. This reduced hydrophilicity is particularly evident from the substantially poorer wash-out properties of the lithographic printing plates or offset printing plates exposed imagewise to actinic light and finally also from the poor printing behavior and from the quality of the printed copies and the length of the print run.

Accordingly, the necessity of further developing the known processes for the anodic oxidation of plates, foils or ribbons of aluminum or aluminum alloys has in no way diminished. On the contrary, it has increased as a result of the higher requirements set in practice.

It is an object of the present invention to provide a novel process for the anodic oxidation of plates, foils or ribbons of aluminum or aluminum alloys, which no longer has the disadvantages of the prior art either with respect to its procedure or with respect to its products and their secondary products.

We have found that this object is achieved by a process for the anodic oxidation of plates, foils or ribbons consisting of aluminum or aluminum alloys, in which the anodic oxidation is carried out in an aqueous electrolyte containing one or more acids and, if required, one or more additives, and which comprises using, as the additive or as one of the additives or as the acid or as one of the acids, one or more silanes of the general formula I $$X-(CH_2)_y-Si(R^1)_n(OR^2)_{3-n} \qquad \text{I}$$

where y is an integer from 1 to 4, n, independently of y, is 0, 1 or 2, $R^1$ and $R^2$ are identical or different and are each $C_1$–$C_9$-alkyl or $C_6$–$C_{12}$-aryl, and X is one of the radicals $X^1$ to $X^{11}$

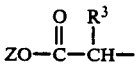
$X^1$

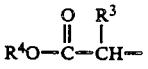
$X^2$

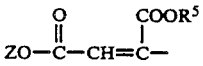
$X^3$

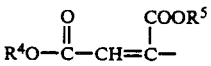
$X^4$

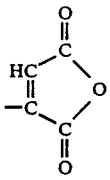
$X^5$

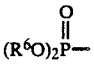
$X^6$

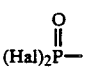
$X^7$ $ZO_3S-$ $X^8$ $HalO_2S-$ $X^9$

-continued $ZO_3S-Ar-$ $X^{10}$ $HalO_2S-Ar-$ $X^{11}$ where $R^3$ is hydrogen, $C_1$–$C_9$-alkyl, an alkanecarboxylic acid radical of 1 to 9 carbon atoms or a carboxylic anhydride ring formed from the alkanecarboxylic acid radical of 1 to 9 carbon atoms and the methylenecarboxylic acid group

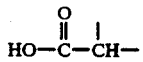

bonded to $R^3$, $R^4$ and $R^5$ are each a radical $R^1$, $R^6$ is hydrogen or a radical $R^1$, Z is hydrogen or an alkali metal cation, Ar is $C_6$–$C_{12}$-arylene and Hal is chlorine or bromine, the silanes of the general formula I (=silanes I) being dissolved in hydrolyzed and/or condensed form in the electrolyte solution.

The novel process for the anodic oxidation of plates, foils or ribbons of aluminum or aluminum alloys is referred to below as the novel process for short.

An essential feature of the novel process is the novel aqueous electrolyte to be used here, which contains the silanes of the general formula I (=silanes I).

Examples of suitable radicals $R^1$ and $R^2$ in the silanes I to be used according to the invention are methyl, ethyl, propyl, isopropyl, n-butyl, sec-butyl, tert-butyl, n-pentyl, isopentyl, neopentyl, hexyl, heptyl, octyl, isooctyl, nonyl, phenyl, benzyl, o-, m- and p-tolyl, 2,4-dimethylphen-1-yl, 3,5-dimethylphen-1-yl, naphth-1-yl and naphth-2-yl. $R^1$ and $R^2$ in each of the silanes I used are identical or different.

Suitable radicals X in the silanes I to be used according to the invention are the radicals $X^1$ to $X^{11}$.

Examples of suitable radicals $X^1$ are those in which Z is hydrogen or a lithium, sodium or potassium cation and $R^3$ is one of the abovementioned alkyl radicals $R^1$, carboxyl, a methanecarboxylic acid, eth-1-yl-2-carboxylic acid, prop-1-yl-3-carboxylic acid, n-but-1-yl-2-, -3- or -4-carboxylic acid, n-pent-1-yl-2-, -3-, -4- or -5- carboxylic acid, n-hex-1-yl-6-carboxylic acid, n-hept-1-yl-7-carboxylic acid, n-oct-1-yl-8-carboxylic acid or n-non-1-yl-9-carboxylic acid radical or a carboxylic anhydride ring which is formed from one of the stated alkanecarboxylic acid radicals of 1 to 9 carbon atoms and the methylenecarboxylic acid group

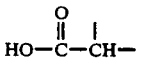

which is bonded to it, for example 2,4-dioxo-oxetan-3-yl, 2,5-dioxo-oxalan-3-yl or 2,6-dioxo-oxan-3-yl.

Examples of suitable radicals $X^2$ are those in which $R^4$ is one of the abovementioned radicals $R^1$.

Examples of suitable radicals $X^3$ are those in which Z has the abovementioned meanings and $R^5$ is one of the abovementioned radicals $R^1$.

Another suitable radical X is the maleic anhydride radical $X^5$.

Examples of suitable radicals $X^6$ are those in which $R^6$ is hydrogen or one of the abovementioned radicals $R^1$.

The suitable radicals $X^7$ are dichloro-, dibromo- and chlorobromophosphonyl.

The suitable radicals $X^8$ are the sulfo group and the lithium, sodium and potassium sulfonate groups.

The suitable radicals $X^9$ are chlorosulfonyl and bromosulfonyl.

Examples of suitable radicals $X^{10}$ are phen-1-yl-2-, -3- and -4-sulfonic acid, 2-methylphen-1-yl-3-, -4-, -5- and -6-sulfonic acid, 4-methylphen-1-yl-2- and -3-sulfonic acid, benzyl-2-, -3- and -4-sulfonic acid, naphth-1-yl-2-, -3-, -4-, -5-, -6-, -7- and -8-sulfonic acid, naphth-2-yl-1-, -3-, -4-, -5-, -6-, -7- and -8-sulfonic acid and the lithium, sodium and potassium salts of these sulfonic acids.

Examples of suitable radicals $X^{11}$ are the chlorides and bromides of the abovementioned sulfonic acids $X^{10}$.

In the silanes I to be used according to the invention, y is an integer from 1 to 4 and n, independently of y, is 0, 1 or 2.

Examples of silanes I which are particularly advantageously used in the novel process are (2-tripropoxysilylethyl)-carboxylic acid, (3-trimethoxysilylpropyl)-carboxylic acid, (4-trimethoxysilylbutyl)-carboxylic acid and their methyl, ethyl, propyl and butyl esters, (3-triethoxysilylpropyl)-succinic anhydride, (3-triethoxysilylpropyl)-maleic anhydride, (2-trimethoxysilylethyl)-phosphonic acid, dimethyl (2-trimethoxysilylethyl)-phosphonate, dimethyl and diethyl (3-triethoxysilylpropyl)-phosphonate, (2-trimethoxysilylmethyl)-phosphonyl dichloride, (3-trimethoxysilylpropyl)-phosphonyl dichloride, (3-trimethoxysilylpropyl)-phosphonic acid, 2-(4-chlorosulfonylphenyl)-ethyltrimethoxysilane, 2-(4-sulfonylphenyl)ethyltrimethoxysilane, (3-trimethoxysilylpropyl)-sulfonyl chloride and (3-trimethoxysilylpropyl)-sulfonic acid.

The silanes I are compounds which have long been known and which are synthesized from commercial compounds in a simple manner by conventional and known methods of silicon chemistry. For example, silicon halides and the appropriate organic compounds which contain the particular desired radicals $(—CH_2)_y$-X, $R^1$ and $R^2$ of the silanes I or the precursors of these radicals are used for this purpose.

The hydrolysis of the silanes I takes place during dissolution of the silanes I in the aqueous electrolyte. It is known that this also initiates the condensation of the silanes I, which takes place with elimination of alcohol. Depending on the silane I used, the condensation reaction takes place more or less completely and therefore leads to mixtures of hydrolyzed, condensed silanes I having different molecular weights, i.e. different degrees of condensation. During the hydrolysis of the silanes I, of course, the corresponding free acid groups are formed from the ester, anhydride or acid halide groups. Here too, the degree of reaction, i.e. the degree of hydrolysis, is dependent on the particular silane I used. Accordingly, for a preselected silane I, the degree of hydrolysis may be low but the degree of condensation high. The converse is also possible, i.e. the degree of hydrolysis is high whereas the degree of condensation is low. However, it is also possible for both reactions, hydrolysis as well as condensation, to reach a high degree of conversion, i.e. to take place virtually completely or as good as completely.

Furthermore, the hydrolysis and the condensation of the silanes I take place through the dissolution of the silanes I in water or aqueous alcoholic solutions, prior to the addition of these solutions to the electrolyte.

Since these modes of reaction of the silanes I are usual, known and typical for the compounds and inevitably take place when the silanes I are used according to the invention, they will not be expressly referred to again below.

Regardless of the procedure chosen for the addition of the silanes I to the aqueous electrolyte, the advantages of the novel process are always reliably obtained. If the silanes I are separately hydrolyzed and/or condensed before being added to the aqueous electrolyte, the amount of solvent used for this purpose is of course only sufficient to obtain the desired concentration of silane I in the aqueous electrolyte after the addition of the silane I solution to the said electrolyte.

In the aqueous electrolyte, the silanes I to be used according to the invention fulfill the function of additives, which are introduced into the aqueous electrolyte in addition to an acid or a plurality of acids. The silanes I are, however, also used together with other additives which very generally serve, during the anodic oxidation itself, to modify or color the resulting surface layer, which mainly consists of aluminum oxides, or to deposit a further layer of, for example, organic material on this surface layer.

If the silanes I possess acid groups or form acid groups during their hydrolysis and condensation, they also fulfill the function of the single acid or the function of one of a plurality of acids of the aqueous electrolyte. Usually, the acids in the aqueous electrolyte serve to increase its conductivity and are also known to have a considerable effect on the physicochemical properties and performance characteristics of the surface layers which mainly consist of aluminum oxides and are formed during the anodic oxidation.

It cannot be stated precisely whether, on the basis of their action, the silanes I are to be regarded as additives rather than as acids, since the silanes I fulfill both functions in an advantageous manner in the novel process, i.e. the silanes I have performance characteristics which otherwise can only approximately be achieved by combining a plurality of different substances, if at all.

The aqueous electrolyte advantageously contains the silanes I in an amount of from 0.001 to 50% by weight, based on the electrolyte. If the aqueous electrolyte contains less than 0.001% by weight of the silanes I, their advantageous technical effect cannot be reliably reproduced in all cases. On the other hand, because of the advantageous technical effect of the silanes I, it is unnecessary to increase their content in the aqueous electrolyte to more than 50% by weight, because the additional advantages which can be achieved as a result do not necessarily justify the higher consumption of silanes I. Thus, both from the point of view of application technology and for economic reasons, the content of 0.001–50% by weight of silanes I is an optimum range, within which the concentration of silane I is widely varied and is simply and advantageously adapted to the technical objects to be achieved and to the available apparatuses.

If, for example, the silanes I alone are added to the aqueous electrolyte, a content of silane I of from 0.05 to 30, preferably from 0.1 to 25, in particular from 1 to 10, % by weight, based on the electrolyte, has proven particularly advantageous.

If the silanes I are used together with an acid or with a plurality of acids in the aqueous electrolyte, a content of silane I of from 0.005 to 25, preferably from 0.05 to 20, in particular from 0.08 to 10, % by weight, based on the electrolyte, is particularly advantageous. It is an additional advantage if the aqueous electrolyte contains from 0.5 to 50, preferably from 1 to 35, in particular from 3 to 30, % by weight of the acid or acids concomitantly used. The concomitantly used acids are selected from the group consisting of the inorganic mineral acids, the low molecular weight mono- and polyfunctional organic carboxylic, sulfonic and phosphonic acids and the oligomeric and high molecular weight polyfunctional carboxylic, sulfonic and phosphonic acids. Suitable acids are disclosed in EP-No. A-0 048 909 and EP-No. A-0 050 216 and in the prior art discussed in detail in these patents.

If, in addition, conventional and known additives are introduced, in molecular disperse form or as colloidal solutions, into the aqueous electrolyte, their amount depends in particular on their solubility in the aqueous electrolyte and on the extent to which they influence the solubility of the silanes I. Accordingly, the conventional and known additives can be added in amounts which are required to achieve the particular technical effect which they usually produce, provided that they do not result in dehomogenization of the aqueous electrolyte, for example through formation of separate liquid phases or insoluble precipitates. The usual and known additives are generally selected from the group consisting of the inorganic and organic salts and the low molecular weight, oligomeric and high molecular weight non-acidic organic compounds. Examples of suitable additives are likewise disclosed in EP-No. A-0 048 909 and EP-No. A-0 050 216 and in the prior art discussed in detail therein.

According to the invention, it is very particularly advantageous if an aqueous electrolyte which contains sulfuric acid and/or phosphoric acid in addition to the silanes I is used in the novel process.

It is also very particularly advantageous according to the invention to carry out the novel process in two stages, i.e. first anodically to oxidize the surface of the plates, foils and ribbons of aluminum and aluminum alloys in a known aqueous electrolyte and thereafter, in the second stage, anodically to oxidize the said plates, foils and ribbons in the aqueous electrolyte to be used according to the invention and containing the silanes I.

The novel process is carried out in apparatuses or plants such as those conventionally used for the anodic oxidation of aluminum. The process according to the invention therefore does not require any new investment in apparatuses and plants which have to be developed specially for the purpose; on the contrary, it is not even necessary to carry out major modifications to existing apparatuses and plants.

The apparatuses and plants in which the novel process is carried out essentially comprise electrolysis tanks, regulatable current and voltage sources, holders for the plates, foils or ribbons and the conventional and known control and measurement apparatuses. Moreover, the electrolysis tanks can contain stirrers, cooling means and means for feeding in and removing the aqueous electrolyte and for purifying the latter. The holders are of course connected to the particular current and voltage sources. These known apparatuses and plants can be designed for continuous or batchwise operation, i.e. the novel process can be carried out continuously or batchwise.

If the novel process is carried out batchwise, some or all of its parameters change in the course of the process from a preselected initial state to a desired end state. For example, the temperature of the aqueous electrolyte, the voltage, the current density and/or the acid concentration and additive concentration are altered in a predetermined manner during the anodic oxidation in order to achieve a very particularly advantageous technical effect.

It is also possible to carry out the novel process while keeping some or all process parameters constant.

The process according to the invention is, however, also carried out continuously, the process parameters being kept constant in the desired range, in accordance with the procedure for a continuous process, and the plates, foils or ribbons consisting of aluminum or aluminum alloys being fed continuously through the aqueous electrolyte.

Regardless of whether the novel process is carried out continuously or batchwise, the temperature of the electrolyte to be used according to the invention is from $-2°$ to $+60°$ C. The novel process uses d.c. voltage, a.c. voltage or a.c. voltage-superposed d.c. voltage of 1–75 V, both for the continuous and the batchwise procedure. In both embodiments of the novel process, quantities of electricity of from 2 to 100 $kC/m^2$ have proven advantageous. The process gives particularly advantageous results for a duration of anodic oxidation of from 4 seconds to 5 minutes.

It is advantageous to select the predominant number of process parameters of the novel process from the abovementioned ranges. It is particularly advantageous to select all process parameters from these ranges. After selection and adjustment of the process parameters, the majority of these parameters are kept constant in the abovementioned range over the entire course of the anodic oxidation. Alternatively, these process parameters are selected and adjusted, after which some or all of the process parameters change in the course of the anodic oxidation from the initial state until the desired end state is reached. This change is effected according to a particular program or results automatically from the interaction of the changing process parameters with one another and with the changing nature of the surface to be oxidized. In this respect, it is very particularly advantageous if the process parameters are within the abovementioned ranges when the desired end state is reached.

Particularly excellent results are obtained in the novel process in which the anodic oxidation is carried out in the course of from 4 seconds to 5 minutes at from $-2°$ to $+60°$ C. with a d.c. voltage of from 1 to 75 V and a quantity of electricity of from 2 to 100 $kC/m^2$ using an aqueous electrolyte containing from 0.05 to 50% by weight, based on its total amount, of the silanes I.

Prior to the novel process, the surface of the plates, foils or ribbons of aluminum or aluminum alloys can be cleaned by a conventional method customarily used in this technical area. Examples of suitable cleaning methods are washing with water, aqueous alkaline solutions, acids and organic solvents. It is also known that the conventional cleaning methods can be combined with one another in a suitable manner. In this context, reference may be made to, for example, DE-B-29 12 060.

The novel process can moreover be preceded by mechanical, chemical and/or electrochemical roughening of the surface of the plates, foils or ribbons of aluminum or aluminum alloys in a manner known and conventionally used in this technical area. This roughening is usually carried out after cleaning and is normally followed by a further cleaning step. Examples of suitable roughening processes are disclosed in DE-A-25 57 222, DE-A-26 50 762 or DE-B-29 12 060.

The novel process can be followed by conventional and known aftertreatment processes for the surface layer essentially consisting of aluminum oxides. Examples of suitable aftertreatment processes are sealing, hardening and hydrophilization of the surface layer. Treatment with hot steam is known to be suitable for sealing, and chemical and electrochemical aftertreatment with halides and acids is known to be suitable for hardening and/or hydrophilization. In this context, reference may be made to, for example, DE-C-26 07 207. This aftertreatment may furthermore be followed by a drying step.

In addition, silanes I can be applied to the resulting surface layer essentially consisting of aluminum oxides, after the novel process has been carried out or after the subsequently effected aftertreatment, in order further to improve their property profile, which in any case is excellent.

The novel process has many particular advantages, which were not expected to this extent.

The process according to the invention can be carried out in apparatuses and plants known and conventionally used for anodic oxidation. The novel process gives, in a reliable and simple manner, products having excellent performance characteristics and therefore does not require any new investment in apparatuses and plants specially developed for this purpose.

The surface layers produced with the aid of the novel process and essentially consisting of aluminum oxides, on moldings of aluminum or aluminum alloys, have a good appearance, particularly high corrosion resistance, excellent hardness, very good resistance to wear and very good colorability,, so that the relevant parts can also be advantageously used for architectural purposes, for example as window frames, door jambs or cover panels, or for light mechanical engineering. In this respect, the fact that the density and the structure of the relevant surface layers can on the one hand be varied widely in a simple manner and on the other hand be very precisely adjusted in a thickness range of from 0.1 to 150 g/m$^2$, corresponding to about 0.1–200 $\mu$m, has proven a further very particular advantage of the novel process.

The novel process is particularly preferably used for the production of photosensitive lithographic printing plates or offset printing plates, because it is here that its many advantages are displayed to a particularly high extent.

For example, in addition to having the abovementioned advantages, the surface layers of the anodically oxidized plates, foils or ribbons of aluminum or aluminum alloys, which layers are produced by the novel process and essentially consist of aluminum oxides, possess particularly high absorptivity and adhesion for coatings, synthetic resins and photosensitive mixtures having a very wide variety of compositions. Moreover, the surface layers are hard, hard-wearing and abrasion resistant and also very tough and resistant to breakage. They are also very hydrophilic and have high chemical and physical stability during storage and excellent ink conveying properties during printing. The density, thickness and structure of the surface layers can be widely varied and can be preferably adapted to the photosensitive mixtures to be applied and the printing requirements.

It is noteworthy that the 0.05–1.5 mm thick anodically oxidized plates, foils or ribbons consisting of aluminum or aluminum alloys, which are produced by the novel process and referred to below as bases, can be covered with photosensitive mixtures having a very wide variety of compositions in a thickness from 0.1 to 20 $\mu$m, in particular from 0.5 to 5 $\mu$m and in this way give photosensitive lithographic printing plates or offset printing plates which are suitable for both rapid imagewise exposure to computer-controlled lasers, i.e. coherent actinic light, and conventional imagewise exposure to incoherent actinic light through a photographic negative.

Examples of photosensitive mixtures which can be applied to the bases anodically oxidized by the novel process and then form the photosensitive recording layer of the photosensitive lithographic printing plates or offset printing plates on the said bases are all those mixtures which, in the form of photosensitive recording layers and as a result of the imagewise exposure to coherent or incoherent actinic light, (a) accept printing ink and/or become insoluble in their exposed areas, their unexposed areas being capable of being washed out with a developer, or
(b) repel printing ink and/or become soluble in their exposed areas, the exposed areas being capable of being washed out with a developer, or
(c) become electrically conductive in their exposed areas and retain their electrically insulating effect in their unexposed areas, so that they are capable of giving latent electrostatic images.

Typical examples of photosensitive recording layers of photosensitive lithographic printing plates or offset printing plates of the type stated under point (a) are those described in DE-C-26 07 207, which are particularly suitable for imagewise exposure to laser light. Other suitable recording layers are the conventional and known recording layers, which essentially consist of ($a_1$) a hydrophilic polymer, such as gelatine or glue, and a photosensitive metal salt,
($a_2$) a hydrophilic polymer, such as gelatine, fish gelatine, gum arabic, polyvinyl alcohol, polyacrylamide, carboxymethylcellulose or hydroxyethylcellulose, or copolymers of polyvinyl methyl ether and maleic anhydride and the tetrazonium salt of a diamino compound such as p-aminodiphenylamine, benzidine, diamidine or toluidine
($a_3$) a diazo resin which is essentially prepared from formaldehyde and a diphenylamine-diazonium salt,
($a_4$) an azide compound, such as sodium 4,4'-diazidostilbene-2,2'-disulfonate, sodium 1,5-diazidonaphthalene-3,7-disulfonate, sodium 3'-azido-4-azidobenzalacetophenone-2-sulfonate, sodium 4,4'-diazidostilbene-$\alpha$-carboxylate, sodium di-(4-azido-2'-hydroxybenzal)-acetone-2-sulfonate, sodium 4-azidobenzalacetophenone-2-sulfonate or sodium 4,4'-diazidodiphenyl-3,3'-disulfonate, and polyacrylamide, polyvinylpyrrolidone, polyacrylic acid, gelatine, casein, albumin, gum arabic, carboxymethylcellulose, hydroxyethylcellulose or an alcohol-soluble polyamide,
($a_5$) an azido compound, such as 4,4'-diazidostilbene, 4,4'-diazidochalcone or 4,4'-diazidobenzalacetone, and a cyclized rubber, a synthetic rubber or another polymer soluble in organic solvents,
($a_6$) a compound which dimerizes on irradiation with actinic light, for example polyvinyl cinnamate, poly-(vinylcinnamoylethyl ether), poly-(ethyl cinnamate acrylate), poly-(ethyl cinnamate methacrylate), poly-(p-vinylphenyl cinnamate), poly-(vinylbenzalacetophenone), poly-(vinylcinnamylidene acetate), allyl acrylate prepolymers or derivatives of polyester resins of p-phenylenediacrylic acid and polyhydric alcohols, ($a_7$) one or more polymeric binders which are soluble or readily dispersible in developers, one or more monomers which are compatible with the particular binders and contain photopolymerizable olefinically unsaturated groups, and one or more photopolymerization initiators or ($a_8$) one or more diazo resins which are essentially prepared from formaldehyde and a diphenylaminediazonium salt, and one or more polymers which are soluble or readily dispersible in aqueous developers, as binders.

The photosensitive recording layers ($a_1$) to ($a_8$) of photosensitive lithographic printing plates or offset printing plates become insoluble in their exposed areas on imagewise exposure to incoherent actinic light through a photographic negative or to laser light and accept in these areas the printing inks of the oil-in-water type, which are typical for offset printing, whereas their unexposed areas can be washed out with developers. The hydrophilic and printing ink-repelling surface of the bases, of the said printing plates, which are anodically oxidized by the novel process are bared as a result of this procedure, so that a differentiation is achieved between the surface of the printing plates in the ink-conveying image areas and ink-repelling non-image areas.

Typical examples of photosensitive recording layers of photosensitive lithographic printing plates or offset printing plates of the type stated under point (b) essentially consist of ($b_1$) a quinone diazido compound, such as naphthoquinone-1,2-diazidosulfonates, -sulfonic acid, -sulfonyl chloride or sulfonamide, and an alkali-soluble binder, ($b_2$) a compound which eliminates an acid on exposure to light, a monomeric or polymeric compound which possesses one or more C—O—C groups which can be eliminated by an acid, for example an o-carboxylic ester group or a carboxamidoacetal group, and, if necessary, a binder or ($b_3$) a compound having two or more aromatic and/or heteroaromatic o-nitrocarbinol ester groups, a crosslinking compound having two or more reactive groups capable of reacting with carboxyl groups on heating, and a catalyst which accelerates this reaction, for example iodonium, sulfoxonium or pyrrylium salts.

The photosensitive recording layers ($b_1$) to ($b_3$) of the photosensitive lithographic printing plates or offset printing plates become soluble in their exposed areas on imagewise exposure to incoherent actinic light through a photographic negative or to laser light, after which these areas can be washed out with developers. This bares the hydrophilic and therefore ink-repelling surface of the bases of the said printing plates, these bases having been anodically oxidized by the novel process. The unexposed areas on the other hand remain insoluble and accept the printing inks of the oil-in-water type, which are typical for offset printing, so that in this case too differentiation is finally achieved between the ink-conveying image areas and ink-repelling non-image areas of the printing plate surfaces.

Typical examples of photosensitive recording layers of photosensitive lithographic printing plates of the type stated under point (c) are generally referred to as electrophotographic recording layers and essentially consist of one or more binders which are soluble or readily dispersible in developers, one or more photoconductors and one or more sensitizers. These electrophotographic recording layers are charged to a surface potential of several hundred volt by means of a high voltage corona and then exposed imagewise to incoherent actinic light through a photographic negative or to laser light, with the result that they become electrically conductive in their exposed areas, so that the surface potential can flow away via the bases anodically oxidized by the novel process. In their unexposed areas, however, the electrically insulating effect of the electrophotographic recording layers is retained, so that in general latent electrostatic images result and can be rendered visible by means of conventional and known toners. The toner images produced in this manner are fixed by heating. Thereafter, the unexposed and therefore toner-free area of the electrophotographic recording layers are washed out, so that here too, as described above, the differentiation between the ink-conveying image areas and ink-repelling non-image areas of the printing plate surface results, this differentiation being typical of offset printing.

Regardless of the type of photosensitive recording layers selected for the production of the photosensitive lithographic printing plates or offset printing plates, and regardless of whether, after their production, these photosensitive recording layers are exposed imagewise through a photographic negative to short-wavelength or long-wavelength ultraviolet light or to visible light or to ultraviolet, visible or infrared laser light and then washed out with an organic, aqueous alkaline or aqueous alcoholic developer or with water, the particular advantages of the bases anodically oxidized by the novel process are displayed. The high photosensitivity of the photosensitive lithographic printing plates or offset printing plates, which also permits the very fine and very critical image elements of photographic negatives to be reproduced completely faithful to detail, rapidly and reliably, should be mentioned in particular.

The particular advantages of the novel process do not end here but are also found in the lithographic printing plates or offset printing plates produced from the photosensitive lithographic printing plates or offset printing plates. For example, the relevant printing plates are abrasion-resistant under printing conditions and give excellent printed copies in advantageously long print runs.

The particular advantages of the novel process become apparent in an excellent manner in photosensitive lithographic printing plates which contain photosensitive recording layers ($a_7$), ($a_8$) or (c).

These photosensitive recording layers are produced in a conventional and known manner by (i) preparing a mixture which consists of the components of the relevant photosensitive recording layer ($a_7$), ($a_8$) or (c) by means of conventional and known kneading, mixing or dissolution techniques, (ii) dissolving the photosensitive mixture prepared in this manner in a suitable solvent, (iii) pouring the resulting solution onto the surface of the base anodically oxidized by the novel process, so that a solvent-moist photosensitive recording layer ($a_7$), ($a_8$) or (c) results on the base, and (iv) drying the said solvent-moist recording layer produced in this manner to give the photosensitive recording layer ($a_7$), ($a_8$) or (c) on the base.

The photosensitive recording layer ($a_7$) or ($a_8$) produced in this manner can then be matted in a conventional and known manner, coated with a smooth or matt top layer which is soluble or readily dispersible in the relevant developers for ($a_7$) or ($a_8$) or covered with a readily detachable, smooth or matt cover sheet. However, it is known that the top layer and the cover sheet can also be used together, the top layer being directly on top of the particular photosensitive recording layer.

Examples of suitable binders for the production of the photosensitive recording layers ($a_7$) are methyl methacrylate/methacrylic acid copolymers, styrene/methacrylic acid copolymers, methacrylic acid/acrylic acid copolymers, polyurethanes and unsaturated polyesters and polyesterurethanes.

Examples of suitable monomers having photopolymerizable olefinically unsaturated groups for the production of the photosensitive recording layers ($a_7$) are mono-, di- and poly(meth)acrylates, as obtained by the esterification of monoalcohols, diols and polyols, with acrylic acid and methacrylic acid or their derivatives.

Examples of suitable photopolymerization initiators are benzoin, benzoin ethers, benzil acetals, acylphosphine oxides, Michler's ketone, anthraquinones, arylsubstituted imidazoles, acridines, phenazines or compounds which readily eliminate halogen atoms on exposure.

Thermal polymerization inhibitors, dyes, pigments, photochromic compounds or systems, sensitometric regulators, plasticizers, leveling agents, matting agents or lubricants can also be used for the production of the photosensitive recording layers ($a_7$).

All these components for the production of the said layers ($a_7$) are used in the conventional and known amounts. These amounts are disclosed for example in EP-No. A-0 089 802.

Examples of suitable diazo resins for the production of the photosensitive recording layers ($a_8$) are the condensates of diphenylamine-4-diazonium sulfate, hexafluorophosphate, tetrafluorophosphate or tetrafluoroborate with formaldehyde, or the condensates of 3-methoxydiphenylamine-4-diazonium sulfate with 4,4'-bismethoxymethyldiphenyl ether, which are isolated as mesitylenesulfonate or methanesulfonate salts.

Examples of suitable binders for the production of the photosensitive recording layers ($a_8$) are copolymers of acrylic acid, methacrylic acid and/or crotonic acid, as essential components, with acrylonitrile, alkyl (meth)acrylates, such as ethyl methacrylate, and hydroxyalkyl (meth)acrylates, such as 2-hydroxyethyl methacrylate.

Examples of suitable solvents for the components of the photosensitive recording layers ($a_8$) are those stated in DE-A-36 27 585, of which diacetone alcohol is very particularly preferred, contrary to the statements made there.

Organic oligocarboxylic acids, such as tartaric acids, dyes, pigments, leveling agents, plasticizers and the conventional and known stabilizers for diazo resins can also be used for the production of the photosensitive recording layers ($a_8$).

All these components for the production of the said layers ($a_8$) are used in the conventional and known amounts. These amounts are disclosed for example in DE-A-36 27 585.

Examples of suitable binders for the production of the electrophotographic recording layers (c) are cellulose ethers, polyester resins, polyvinyl chlorides, polycarbonates or copolymers such as styrene/maleic anhydride, vinyl chloride/maleic anhydride, styrene/maleic anhydride/(meth)acrylic acid or styrene/(meth)acrylic acid copolymers.

Examples of suitable photoconductors for the production of the electrophotographic recording layers (c) are the conventional and known oxazoles, oxadiazoles, triazoles, azomethines, pyrazolines, imidazoles, arylamines, 1,3-dithiols, benzotriazoles, triazolylpyridines, pyrazolotriazoles, triphenyltriazoles, hydrazones, poly(N-vinylcarbazole) and arylamine polymers.

Examples of suitable sensitizers for the production of the said layers (c) are the dyes from the classes consisting of the triarylmethane, cyanine, xanthene, azo, phthalocyanine, naphtholactam or isoindolenine dyes.

Leveling agents, plasticizers, adhesion promoters, fillers and metal complexes, such as metal acetylacetonates, can also be used for the production of the electrophotographic recording layers (c).

All these components for the production of the said layers (c) are used in the conventional and known amounts. These amounts are disclosed in, for example, EP-No. A-0 131 215.

These photosensitive lithographic printing plates or offset printing plates having a base, which has been anodically oxidized by the novel process, and the photosensitive recording layer ($a_7$), ($a_8$) or (c) give, after the conventional and known exposure and development which are typical for each of these said layers, excellent lithographic printing plates or offset printing plates, which once again display the particular advantages of the novel process.

The exposure and development of photosensitive printing plates having the recording layer ($a_7$) is described in detail in EP-No. A-0 089 802.

The exposure and development of photosensitive printing plates having the recording layer ($a_8$) is disclosed in detail in DE-A-36 27 585.

The exposure and development of photosensitive printing plates having the recording layer (c) is disclosed in all its features in EP-No. A-0 131 215.

These lithographic printing plates or offset printing plates which have been produced using the bases anodically oxidized by the novel process are distinguished in particular by excellent hydrophilicity in their non-image areas and by excellent adhesion of their image areas to the base. Moreover, they give excellent printed copies in very long print runs during printing.

EXAMPLES AND COMPARATIVE EXPERIMENTS

In the Examples and Comparative Experiments below, the lithographic printing plates or offset printing plates were inked with an offset printing ink of the oil-in-water type in order to test their ink-conveying properties and the hydrophilicity of their non-image areas. Thereafter, the offset printing ink was washed off again with water. Whether, and to what extent, the particular hydrophilic non-image areas had accepted and retained the printing ink was then assessed visually. The results of each of the visual assessments were rated as follows:

Rating 1 (The printing ink can be washed away completely, no ink acceptance is detectable in the non-image areas, and the offset printing plate meets the highest quality requirements in this respect and is suitable for particularly difficult applications in offset printing)

Rating 2 (Ink residues are still detectable in the non-image areas after washing, but these residues can be removed by rubbing; the offset printing plate is very suitable for offset printing)

Rating 3 (The ink residues in the non-image areas cannot be removed even by rubbing, and the offset printing plate cannot be used for offset printing)

Rating 4 (There is no longer any detectable differentiation between image and non-image areas with regard to ink acceptance; the printing plate is uniformly inked and therefore completely unsuitable for offset printing)

Furthermore, in the Examples and Comparative Experiments below, the lithographic printing plates or offset printing plates were rubbed with a tampon which had been impregnated with a commercial, aqueous alkaline developer typical for offset printing, in order to test the strength of adhesion between the image areas and the bases. Thereafter, whether, and to what extent, the fine image elements had been damaged were assessed visually. The results obtained in each visual assessment were rated as follows:

Robust (No detectable change in the image areas of the offset printing plate even after repeated rubbing)

Somewhat sensitive (After prolonged rubbing, the gray tone areas of tonal value 0.5% and 1% are no longer correctly reproduced; although small image dots have been rubbed off, the offset printing plate is still highly suitable)

Sensitive (After prolonged rubbing, the gray tone areas of tonal values 2%, 3%, 4% and 5% are no longer correctly reproduced but the offset printing plate can still be used for printing)

Too sensitive (Rubbing can even remove the solid areas; the offset printing plate is completely unsuitable for printing).

EXAMPLE 1

The anodic oxidation of aluminum plates with the novel process; experimental method:

Aluminum sheets measuring 280×250×0.3 mm were cleaned with an alkali, electrochemically roughened in hydrochloric acid of concentration 20 g/l at a current density of 60 A/dm$^2$ for 15 seconds, cleaned with an alkali again and then anodically oxidized. Anodic oxidation was carried out using an aqueous electrolyte consisting of 30% strength sulfuric acid which contained 0.1% by weight of 3-(triethoxysilylpropyl)-succinic anhydride; the quantity of electricity was 20 kC/m$^2$, the electrolysis temperature was 30° C. and the electrolysis time was 40 seconds.

Thereafter, the plates were covered with a dense, uniform, attractive surface layer which was mainly composed of aluminum oxides. Further advantages became apparent when the plates were used as bases for offset printing plates.

EXAMPLE 2

The anodic oxidation of aluminum plates by the novel process; experimental method:

Example 1 was repeated, except that (2-trimethoxysilylethyl)-phosphonic acid was used instead of (3-triethoxysilylpropyl)-succinic anhydride. The same advantageous results were obtained as in Example 1. Further advantages became apparent when the plates were used as bases of offset printing plates.

COMPARATIVE EXPERIMENT 1

The anodic oxidation of aluminum plates by a conventional process; experimental method:

Example 1 was repeated, except that 1% by weight of polyvinylphosphonic acid was used instead of 0.1% by weight of (3-triethoxysilylpropyl)-succinic anhydride.

The surface layer obtained here appeared at first glance to be of equal quality to that produced by the novel process; however, its deficiencies became apparent when the plates were used as bases of offset printing plates.

COMPARATIVE EXPERIMENT 2

The anodic oxidation of aluminum plates by a conventional process; experimental method:

Example 1 was repeated without silane I and without polyvinylphosphonic acid.

The surface layer obtained here was less dense, non-uniform and less attractive than that of Example 1 or 2. Further deficiencies became apparent when the plates were used as bases for offset printing plates.

EXAMPLES 3 TO 5

Use of the aluminum plates anodically oxidized according to Example 1 as bases of the photosensitive recording layers of lithographic printing plates or offset printing plates; experimental method:

Three photosensitive mixtures ($a_7$), ($a_8$) and (c) were prepared by dissolving the relevant components in a suitable solvent. The solutions were poured onto the bases and then dried, these steps being carried out in a manner such that the photosensitive recording layers ($a_7$), ($a_8$) and (c) were obtained in the desired thickness and with the desired composition.

The photosensitive lithographic printing plates or offset printing plates thus obtained were exposed imagewise to incoherent actinic light through a standard negative (UGRA test wedge) in a conventional and known manner typical for each of them and were then developed.

The quality of the resulting lithographic printing plates or offset printing plates was then tested and rated in the manner described above. The relevant results are summarized in Table 1.

The offset printing plates were then clamped on printing cylinders and used for continuous printing on a commercial offset printing unit. The assessment of the quality of the resulting printed copies and their print run are also shown in Table 1.

For Example 3, the photosensitive recording layer ($a_7$) was used. This consisted of 59% by weight of a copolymer prepared from methyl methacrylate and methacrylic acid (binder), 30% by weight of butane-1,4-diol diglycidyl ether diacrylate (monomer), 2% by weight of Michler's ketone (photoinitiator), 6% by weight of 2-(4'-methoxynaphth-1'-yl)-4,6-bis-(trichloromethane)-s-triazine (chlorine-eliminating coinitiator), 1% by weight of Victoria Sky Blue (C.I. BB7) and 2% by weight of benzenesulfonic acid n-butylamide (plasticizer), the percentages being based on the total amount of the said layer.

The weight per unit area of the photosensitive recording layer ($a_7$) was 2 g/m$^2$. The said layer was exposed imagewise for 25 seconds using a high pressure mercury lamp (power consumption 3 kW) and then developed with an aqueous alkaline developer in a ®nylolith 650W-2 developing machine from BASF AG.

For Example 4, the photosensitive recording layer ($a_8$) was used. This consisted of 86% by weight of a copolymer prepared from 2-hydroxyethyl methacrylate, acrylonitrile, ethyl methacrylate and methacrylic acid (binder), 2% by weight of tartaric acid, 11.9% by weight of the condensate of diphenylamine-4-di azonium hexafluorophosphate with formaldehyde (diazonium salt) and 0.1% by weight of Victoria Sky Blue (C.I. BB7), the percentages being based on the total weight of the said layer.

The weight per unit area of the photosensitive recording layer ($a_8$) was 2.5 g/m$^2$. The exposure and development conditions corresponded to those of Example 3, except that an exposure time of 45 seconds was chosen (power consumption: 3 kW).

For Example 5, the electrophotographic recording layer (c) was used. This consisted of 54.6% by weight of a copolymer of styrene and methacrylic acid (binder), 45% by weight of 2,5-bis-(4'-N,N-diethylaminophen-1'-yl)-1,3,4-oxadiazole (photoconductor) and 0.4% by weight of C.I. Basic Red 1 (sensitizer), the percentages being based on the total weight of the said layer.

The recording layer (c) was charged to a surface potential of −850 V by means of a high voltage corona of −6.75 kV from a distance of 1 cm. Thereafter, it was exposed imagewise with the aid of a process camera having four halogen lamps of 1000 W each for 15 seconds, with the result that a latent electrostatic charge image was produced, the said image being toned with a commercial toner. This toner image was fixed by heating, after which the fixed toner image on the recording layer (c) was developed in the manner stated in Example 3.

EXAMPLES 6 TO 8

Use of the aluminum plates anodically oxidized according to Example 2 as bases of the photosensitive recording layers of lithographic printing plates or offset printing plates; experimental method:

Examples 3 to 5 were repeated, except that the base from Example 2 was used instead of that from Example 1.

The assessment of the quality of the offset printing plates from Examples 6 to 8 is also shown in Table 1.

COMPARATIVE EXPERIMENTS 3 TO 5

Use of the aluminum plates anodically oxidized according to Comparative Experiment 1 as bases of the photosensitive recording layers of lithographic printing plates or offset printing plates; experimental method:

Examples 3 to 5 were repeated, except that the base from Comparative Experiment 1 was used instead of that from Example 1.

The assessment of the quality of the offset printing plates from Comparative Experiments 3 to 5 are also shown in Table 1.

COMPARATIVE EXPERIMENTS 6 TO 8

Use of the aluminum plates anodically oxidized according to Comparative Experiment 2 as bases of the photosensitive recording layers of lithographic printing plates or offset printing plates; experimental method:

Examples 3 to 5 were repeated, except that the base from Comparative Experiment 2 was used instead of that from Example 1.

The assessment of the quality of the offset printing plates from Comparative Experiments 6 to 8 are also shown in Table 1.

Table 1, which summarizes the assessments of all offset printing plates obtained in Examples 3 to 8 and Comparative Experiments 3 to 8, shows clearly and in relation to practice that the novel process for the anodic oxidation of plates, foils or ribbons of aluminum or aluminum alloys is clearly superior to the conventional processes. The Examples and Comparative Experiments can be compared directly with one another as follows:

Example 3 with Example 6, Comparative Experiment 3 and Comparative Experiment 6 (photosensitive recording layer $a_7$);

Example 4 with Example 7, Comparative Experiment 4 and Comparative Experiment 7 (photosensitive recording layer $a_8$); and Example 5 with Example 8, Comparative Experiment 5 and Comparative Experiment 8 (photosensitive recording layer c).

TABLE 1

Assessment of the quality of lithographic printing plates or offset printing plates having bases anodically oxidized in the manner according to the invention (Examples 3 to 5 in conjunction with Example 1; Examples 6 to 8 in conjunction with Example 2) and that of printing plates having bases anodically oxidized in a conventional manner (Comparative Experiments 3 to 5 in conjunction with Comparative Experiment 1; Comparative Experiments 6 to 8 in conjunction with Comparative Experiment 2)

| | Ink-conveying properties and hydrophilicity Rating | Adhesion Evaluation | Printing behavior | |
|---|---|---|---|---|
| | | | Quality of the printed copies | Length of print run |
| Example No. | | | | |
| 3 | 1 | Somewhat sensitive | Very good | Long |
| 4 | 1 | Somewhat sensitive | Very good | Long |
| 5 | 1 | Somewhat sensitive | Very good | Long |
| 6 | 1 | Somewhat sensitive | Very good | Very long |
| 7 | 1 | Robust | Excellent | Very long |
| 8 | 1 | Robust | Excellent | Very long |
| Comparative Experiment | | | | |
| 3 | 1 | Sensitive | Moderate | Short |
| 4 | 2 | Somewhat sensitive | Moderate to poor | Short |

TABLE 1-continued

Assessment of the quality of lithographic printing plates or offset printing plates having bases anodically oxidized in the manner according to the invention (Examples 3 to 5 in conjunction with Example 1; Examples 6 to 8 in conjunction with Example 2) and that of printing plates having bases anodically oxidized in a conventional manner (Comparative Experiments 3 to 5 in conjunction with Comparative Experiment 1; Comparative Experiments 6 to 8 in conjunction with Comparative Experiment 2)

| | Ink-conveying properties and hydrophilicity Rating | Adhesion Evaluation | Printing behavior: Quality of the printed copies | Printing behavior: Length of print run |
|---|---|---|---|---|
| 5 | 2 | Somewhat sensitive | Poor | Short |
| 6 | 2 | Robust | Unsuitable, no print tests | |
| 7 | 3 | Somewhat sensitive | Poor | Test was terminated |
| 8 | 3 | Somewhat sensitive | Poor | Test was terminated |

We claim:

1. A process for the anodic oxidation of the surface of plates, foils or ribbons consisting of aluminum or aluminum alloys, which comprises: (1) preparing an aqueous electrolyte as the anodizing bath by adding one or more silanes of the formula I $$X-(CH_2)_y-Si(R^1)_n(OR^2)_{3-n} \qquad I$$

wherein y is an integer from 1 to 4, n, independently of y, is 0, 1 or 2, $R^1$ and $R^2$ are each $C_1$–$C_9$-alkyl or $C_6$–$C_{12}$-aryl, X is selected from the group consisting of $X^1$ to $X^{11}$

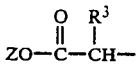
$X^1$

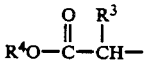
$X^2$

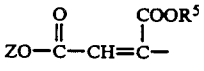
$X^3$

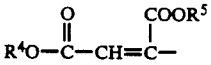
$X^4$

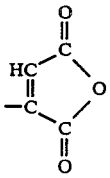
$X^5$

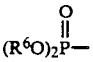
$X^6$

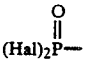
$X^7$ $ZO_3S-$ $X^8$ $HalO_2S-$ $X^9$ $ZO_3S-Ar-$ $X^{10}$ $HalO_2S-Ar-$ $X^{11}$ where $R^3$ is hydrogen, $C_1$–$C_9$-alkyl, an alkanecarboxylic acid group of 1 to 9 carbon atoms or a carboxylic anhydride ring obtained by reacting one of the said alkanecarboxylic acid groups of 1 to 9 carbon atoms with the methylenecarboxylic acid group

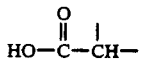

bonded to $R^3$, $R^4$ and $R^5$ are each $C_1$–$C_9$-alkyl or $C_6$–$C_{12}$-aryl, Z is hydrogen or an alkali metal cation, Ar is $C_6$–$C_{12}$-arylene and Hal is chlorine or bromine;

or an aqueous solution of the said silane or silanes I or an aqueous alcoholic solution of the said silane or silanes I to water, to an aqueous solution of additives, to an aqueous solution of organic or inorganic acids or to an aqueous solution of organic or inorganic acids and additives, (2) dipping the said plates, foils or ribbons consisting of aluminum or aluminum alloys into the anodizing bath and (3) anodizing the surface of the plates, foils or ribbons, consisting of aluminum or aluminum alloys to obtain a surface layer consisting essentially of aluminum oxide.

2. A process as defined in claim 1, wherein the aqueous electrolyte is prepared in a manner such that it contains from 0.001 to 50% by weight, based on the electrolyte, of one or more silanes I.

3. A process as defined in claim 1, wherein the surface of the plates, foils or ribbons consisting of aluminum or aluminum alloys is anodized in the course of from 4 seconds to 5 minutes at from −2° to +60° C. with a d.c. voltage of from 5 to 75 V and a quantity of electricity of from 2 to 100 kC/m² in an aqueous electrolyte containing from 0.05 to 50% by weight, based on the electrolyte, of one or more of the silanes I.

4. A process as defined in claim 3, wherein the anodic oxidation of the surface of the plates, foils or ribbons consisting of aluminum or aluminum alloys is carried out batchwise, and some or all of the process parameters change in the course of the anodic oxidation from the preselected initial state until the desired end state is reached.

5. A process as defined in claim 3, wherein the anodic oxidation is carried out batchwise, the majority of its process parameters being kept constant in the desired range over the entire course of the anodic oxidation.

6. A process as defined in claim 3, wherein the anodic oxidation of the surface of the plates, foils or ribbons consisting of aluminum or aluminum alloys is carried out continuously by feeding the said plates, foils or ribbons through the anodizing bath at a constant rate and by keeping the reaction conditions in the desired optimum range.

7. A process as defined in claim 1, wherein the plates, foils or ribbons consisting of aluminum or aluminum alloys are cleaned and then roughened mechanically, chemically and/or electrochemically before the anodic oxidation.

8. A process as defined in claim 1, wherein the surface layer obtained by anodic oxidation and consisting essentially of aluminum oxides is treated with hot steam.

9. A process as defined in claim 1, wherein the surface layer obtained by anodic oxidation and consisting essentially of aluminum oxides is subjected to an aftertreatment which imparts hydrophilic properties to the said surface layer.

10. A process as defined in claim 1 for the production of a photosensitive lithographic printing plate or offset printing plate, wherein the surface layer which consists essentially of aluminum oxides and is obtained by anodic oxidation of 0.05 to 1.5 mm thick plates, foils or ribbons consisting of aluminum or aluminum alloys is covered with a photosensitive recording layer.

* * * * *

UNITED STATES PATENT AND TRADEMARK OFFICE

CERTIFICATE OF CORRECTION

PATENT NO. : 4,939,068

DATED : July 3, 1990

INVENTOR(S) : Harald LAUKE et al.

It is certified that error appears in the above-identified patent and that said Letters Patent is hereby corrected as shown below:

Claim 1, Column 20, Line 23

"$C_6$-$C_{12}$-aryl, Z is hydrogen or an alkali metal cation, Ar" should read --$C_6$-$C_{12}$-aryl, $R^6$ is hydrogen, $C_1$-$C_9$-alkyl or $C_6$-$C_{12}$-aryl, Z is hydrogen or an alkali metal cation, Ar--.

Signed and Sealed this

Twentieth Day of August, 1991

*Attest:*

*Attesting Officer*

HARRY F. MANBECK, JR.

*Commissioner of Patents and Trademarks*